United States Patent [19]

Marshall et al.

[11] Patent Number: 4,637,225

[45] Date of Patent: Jan. 20, 1987

[54] AIR CONDITIONING APPARATUS

[76] Inventors: Ralph C. Marshall, 539 East Ave. J-4, Lancaster, Calif. 93535; Ronald P. Consoli, 16853 Magnolia Blvd., Encino, Calif. 91436

[21] Appl. No.: 797,010

[22] Filed: Nov. 12, 1985

[51] Int. Cl.[4] ..... F25D 21/14

[52] U.S. Cl. ..... 62/285; 62/291

[58] Field of Search ..... 62/91, 285, 286, 288, 62/289, 291

[56] References Cited

U.S. PATENT DOCUMENTS

| | | | |
|---|---|---|---|
| 2,555,968 | 6/1951 | Harbison | 62/286 |
| 2,577,359 | 12/1951 | Phipps | 62/285 |
| 2,776,551 | 1/1957 | Lichtenberger | 62/288 |
| 2,963,882 | 12/1960 | Malkoff et al. | 62/285 |
| 4,182,131 | 1/1980 | Marshall et al. | 62/91 |

FOREIGN PATENT DOCUMENTS 496629 12/1938 United Kingdom .

*Primary Examiner*—Ronald C. Capossela
*Attorney, Agent, or Firm*—Jack C. Munro

[57] ABSTRACT

An air conditioning apparatus that is formed of a housing which is enclosed an internal chamber. Formed within the housing is an air inlet opening which is covered by a cooling pad. Water is to be supplied to the upper edge of the pad and permitted to trickle through the pad and then be deposited within a sump located at the bottom of the housing. From the sump, the water is again supplied to the upper end of the pad. An air movement device, such as a fan, is to cause air to be moved through the inlet opening and then be discharged into the ambient through an outlet opening. A refrigerant fluid closed system is included within the housing which includes a first set of coils and a second set of coils. The first set of coils are located to be contacted by the air that is moved from the inlet opening through the outlet opening. The second set of coils is located within the sump. The first set of coils and the second set of coils facilitate transfer of accumulated heat from the liquid refrigerant contained within the refrigerant fluid closed system to be then discharged from the housing through the outlet opening. Associated with the sump is a water collection device comprising a series of channels which deposits the water into the sump in a turbulent manner.

3 Claims, 2 Drawing Figures

Fig. 1.
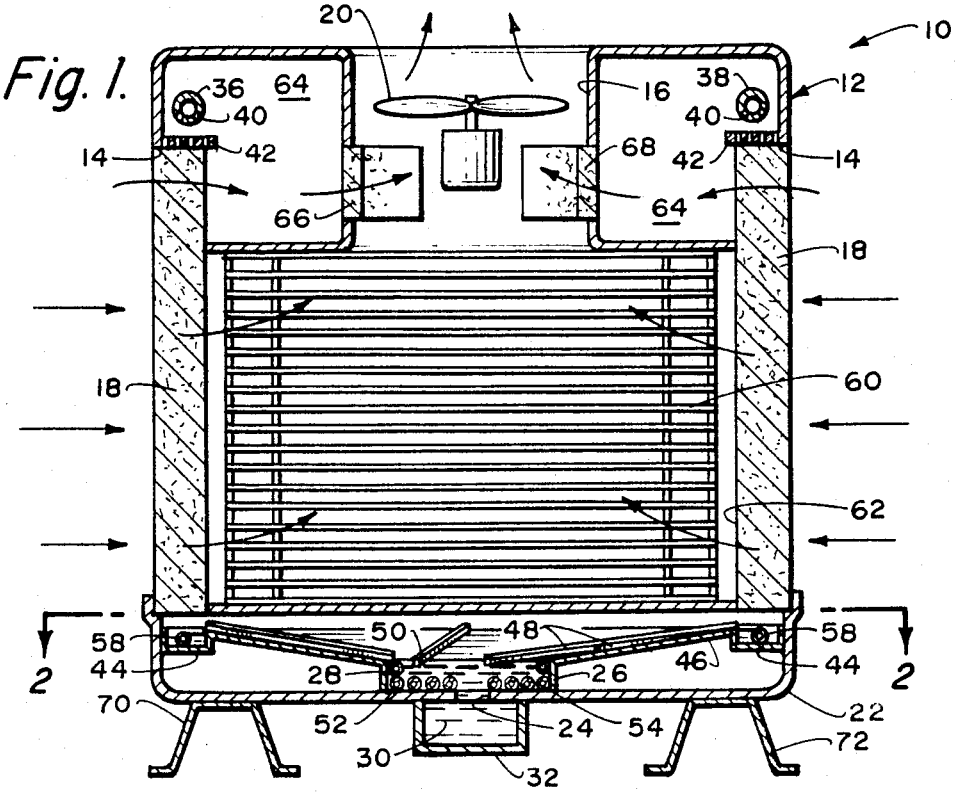
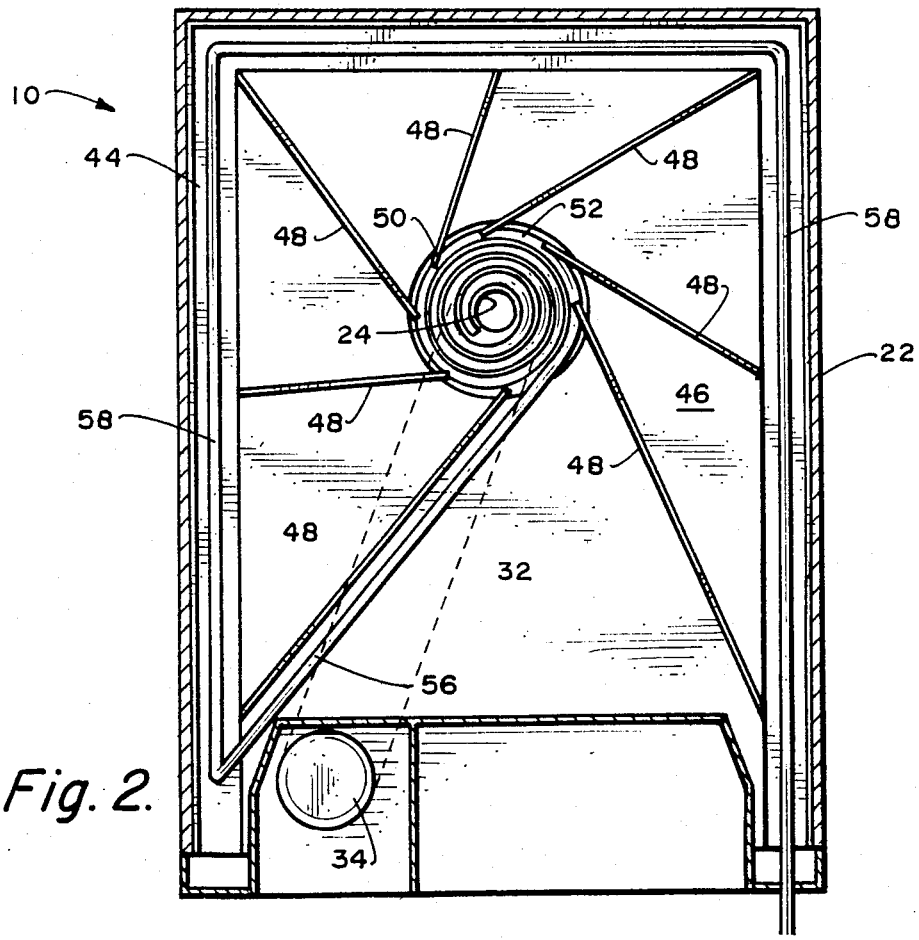
Fig. 2.

AIR CONDITIONING APPARATUS

BACKGROUND OF THE INVENTION

The field of this invention relates to air conditioning systems which utilizes a liquid refrigerant located within a closed coil system which is utilized to extract heat from a given area and discharge such into the ambient.

The structure of the present invention is deemed to be an improvement over the subject matter defined within U.S. Pat. No. 4,182,131 issued Jan. 8, 1980. The subject matter of U.S. Pat. No. 4,182,131 is to be included in this application by reference.

Air conditioning systems of various types have long been known. The principle objective of any air conditioning system is to effect cooling of an enclosed area such as a room of a house or building during times of a hot climate. A common form of any air conditioner comprises a housing within which there is located a fan which moves air through the housing. Also located within the housing is a closed liquid refrigerant system. This closed liquid refrigerant system utilizes a pump which moves liquid refrigerant, such as Freon (a trademark), between the condensing heat exchanger and an evaporating heat exchanger. the evaporating heat exchanger functions to remove heat from the enclosed area and transfer that heat exteriorly of the enclosed area through the condensing heat exchanger.

In the past, substantial effort has been expended to design air conditioning apparatuses to be used efficiently as possible. Clearly, the more efficient an air conditioner is the less energy that is required to operate the air conditioner to produce the desired cooling effect. Even a minor improvement in efficiency can be of substantial significance because of the substantial number of air conditioners in use.

SUMMARY OF THE INVENTION

The structure of the present invention is to construct an air conditioning apparatus which achieves greater efficiency than previous types of air conditioners. This increase in efficiency is obtained in the extraction from the liquid refrigerant closed system as much of the heat as possible so that less energy is required to cool the liquid refrigerant. This extraction of the heat is achieved by positioning of a portion of the coils of the liquid refrigerant within a water bath or sump. The water from the sump is supplied through a cooling pad arrangement across the inlet opening of the air conditioner apparatus to effect cooling of the air as the air is conducted therethrough. The water, after being conducted through the cooling pad, is then caused to flow into a trough which in turn overflows into a series of channels. These channels in turn cause the water to cascade into the sump within which are located cooling coils. The water within each channel is dumped tangentially into the sump so as to maximize turbulent action within the sump and therefore enhance the removal of as much heat as possible from the liquid refrigerant coils.

BRIEF DESCRIPTION OF THE DRAWING

FIG. 1 is a side elevational view in crosssection through the air conditioning apparatus of the present invention; and FIG. 2 is a cross-sectional plan view through a portion of the air conditioning apparatus of the present invention taken along line 2—2 of FIG. 1.

DETAILED DESCRIPTION OF THE SHOWN EMBODIMENT

Referring particularly to the drawing, there is shown the air conditioner apparatus 10 of this invention which is formed of a rigid material housing 12 which has an inlet opening 14 and an outlet opening 16. Housing 12 is basically box-like in configuration. The inlet opening 14 is formed within three sides of the housing 12 with the fourth side being closed.

Supported within the inlet opening 14 is a cooling pad 18. Pad 18 will normally be constructed of an air filter type of material such as threads of plastic, hair, steel wool, or other similar type of material. Mounted within the outlet opening 16 is an electrically operated fan assembly 20.

Attached to the lower end of the housing 12 is a pan 22. Centrally formed within the pan 22 is an opening 24. Interiorly of the opening 24 is located a cylindrically shaped wall 26 forming a sump 28. Within the sump 28 is located a quantity of water 30. The water 30 is to be conducted through the hole 24 into conduit 32. Conduit 32 connects to a pump 34. The pump 34 is to function to move the water 30 through conduits 36 and 38. Actually conduits 36 and 38 will in all probability comprise a single conduit formed in a U-shaped configuration. Both conduits 36 and 38 have a series of holes 40 through which the water is permitted to pass in a series of streams onto an apertured plate 42.

Aperture plate 42 is located over the entire length of the pad 18. The water passes through the aperture plate 42 onto the pad 18 and trickles entirely through the pad 18 to then be deposited within a trough 44 located directly beneath the bottom edge of pad 18. The water then, after filling of the trough 44, spills over onto a water collection plate 46. The water collection plate is divided into a plurality of separate channels by ribs 48. The ribs 48 are so positioned so that each channel narrows as it approaches the sump 28. Also, the ribs 48 are so positioned so that when the water flows from the collection plate 46 to be deposited within the sump 28 that it generally is deposited in a tangential manner within the sump 28. This tangential depositing of the water within the sump 28 tends to increase turbulence within the sump 28.

To further increase turbulence, the plate 46 includes a protruding flange 50. Flange 50 extends within the confines of the sump 28 and actually overhangs a small amount around the entire sump 28. this overhanging flange causes the water to cascade over before being deposited within the sump 28. This cascading further increases the possibility of turbulent action. This turbulent action causes a churning of the water 30 about the tubular coils 52 that are spirally wound within the sump 28. This churning of the water 30 enhances the removal of accumulated heat from the coils 52. The heat is contained within the coils 52 by a liquid refrigerant 54.

Coils 52 are part of a closed refrigerant system which includes a refrigerant pump (not shown). The pump functions to move the refrigerant 54 through the coils 52, through conduit 56, to perimeter conduit 58. Perimeter conduit 58 is positioned entirely within the trough 44. Therefore, not only does the water within the sump 28 function to remove much of the heat from the coils 52 but also additional heat is removed by the fact that the conduit 56 is in contact with water flowing across the plate 46 and that the perimeter conduit 58 is in continuous contact with the water located within the trough 44. The perimeter conduit 58 then extends exteriorly of the housing 12 to connect with an evaporator (not shown) to effect cooling of an enclosed area within which the evaporator is mounted. A typical enclosed area would be rooms of a house or building.

In order to enhance the turbulent action of the water within the sump 28, when observing FIG. 2 a depositing of the water from the plate 46 within the sump 28 is accomplished not only tangentially but counterclockwise as it enters the sump 28. This counterclockwise rotation is in the same direction as the natural whirlpool effect for the northern hemisphere of the earth. This phenomenon is what is frequently referred to as the coriolis effect. It has been found that by making use of this natural whirlpool phenomenon, not only is the flow encouraged from the plate 46 to the sump 28 but also there is an enhanced turbulent action.

Prior to the refrigerant 54 entering coils 52, the refrigerant is conducted through a mass of coils 60. These coils 60 are located within the internal chamber 62 of the housing 12. Air that is conducted through the pad 18 passes through the coils 60 to pick up heat therefrom prior to being ejected into the ambient by the fan 20. Therefore, an initial cooling of the refrigerant within the coils 60 is obtained before the now somewhat cooled refrigerant passes into the coils 52. The moistness of the air passing through the pad 18 enhances this removal of heat from the coils 60.

The portion of the air that passes through the pad 18 that is conducted within housing bulkhead chamber 64 is exited therefrom through vents 66 and 68 to the fan 20. A return conduit (not shown) from the evaporator (not shown) is to be conducted through a conventional compressor prior to the refrigerant 54 being conducted within the coil 60. In a typical installation, the coils 60 will reduce the temperature of the refrigerant to about one hundred forty degrees Fahrenheit and then within the coils 52 as well as conduits 56 and 58 further reducing the temperature of the refrigerant 54 to approximately eighty degrees Fahrenheit.

It is to be understood that if the air conditioner apparatus 10 of this invention was being designed for use primarily for the southern hemisphere, that the plate 46 would be constructed with the ribs 48 so positioned to deposit the water within the sump 28 tangentially clockwise as opposed to counterclockwise. Normally the pan 22 will be fixedly mounted onto mounting brackets 70 and 72 which in turn are to be fixedly mounted at a particularly fixed location such as on the roof of a building or the like.

What is claimed is:

1. An air conditioning apparatus comprising:

a housing forming an internal chamber, said internal chamber having an air inlet opening and an air outlet opening, said housing having a cylindrical sump;

air movement means mounted on said housing within said internal chamber, said air movement means connected with said outlet opening, said air movement means functioning to move air through said inlet opening into said internal chamber and through said outlet opening into the ambient;

air passage means mounted on said housing covering said inlet opening, air is to be moved through said air passage means into said internal chamber;

water contained within said sump, said water to be conducted from said sump and dispersed across said air passage means;

a refrigerant fluid closed system located within said internal chamber, said refrigerant fluid closed system including a first set of coils located within said internal chamber, said first set of coils being located so that the air from said air passage means is conducted across said first set of coils prior to being discharged through said outlet, said refrigerant fluid closed system including a second set of coils, said second set of coils being located within said sump; and water collection means mounted within said internal chamber, said water collection means to receive the water from said air passage means and conduct such into said sump, said water collection means including a plurality of separate channels to divide said water into a plurality of separate paths to be then permanently discharged into said sump, each said channel to tangentially discharge water into said sump, each said channel having a protruding flange, said protruding flange to extend within the confines of said sump and overhang a portion of said sump to cause said water to cascade into said sump thereby increasing turbulence.

2. The air conditioning apparatus as defined in claim 1 wherein:

a trough formed around said channels, said water from said air passage means to be initially deposited within said trough prior to being conducted into said channels.

3. The air conditioning apparatus as defined in claim 2 wherein:

said air passage means comprising a cooling pad assembly.

* * * * *